United States Patent [19]

Brazier et al.

[11] Patent Number: 5,064,158

[45] Date of Patent: Nov. 12, 1991

[54] SHELF SUPPORT

[75] Inventors: Keith Brazier, Shoeburyness; Andrew L. Lee, Surrey; Clifford J. Roberts, London, all of Great Britain

[73] Assignee: Cliffhanger (Export) Limited, United Kingdom

[21] Appl. No.: 26,942

[22] Filed: Mar. 17, 1987

Related U.S. Application Data

[63] Continuation-in-part of Ser. No. 865,850, May 22, 1986, abandoned.

[51] Int. Cl.[5] ..... A47G 29/02

[52] U.S. Cl. ..... 248/250; 248/235; 108/152; 211/90

[58] Field of Search ..... 248/250, 235, 243; 211/90; 108/108, 152; 52/716, 397, 403, 731

[56] References Cited

U.S. PATENT DOCUMENTS

| | | | |
|---|---|---|---|
| 4,385,565 | 5/1983 | Roberts et al. | 248/235 X |
| 4,387,520 | 6/1983 | Ahrens | 52/716 |
| 4,508,301 | 4/1985 | Nicholson et al. | 248/250 |
| 4,537,002 | 8/1985 | Ellingson | 52/403 |
| 4,640,078 | 2/1987 | Haffer | 52/731 |

*Primary Examiner*—Alvin C. Chin-Shue

*Attorney, Agent, or Firm*—Larson & Taylor

[57] ABSTRACT

The shelf support is of the type which extends along the whole of the rear of a glass shelf. The shelf is inserted in a slot formed between a support member and a retaining member so that the shelf is retained as a cantilever. The retaining member carries an elastically-deformable strip which has a main part and spaced protuberances along its bottom. The retaining member is also of special construction, being of generally triangular shape with a slot in its bottom for receiving an upwards projection on the strip and holding the strip in position along the underside of the retaining member.

26 Claims, 3 Drawing Sheets

SHELF SUPPORT

Figure 1:
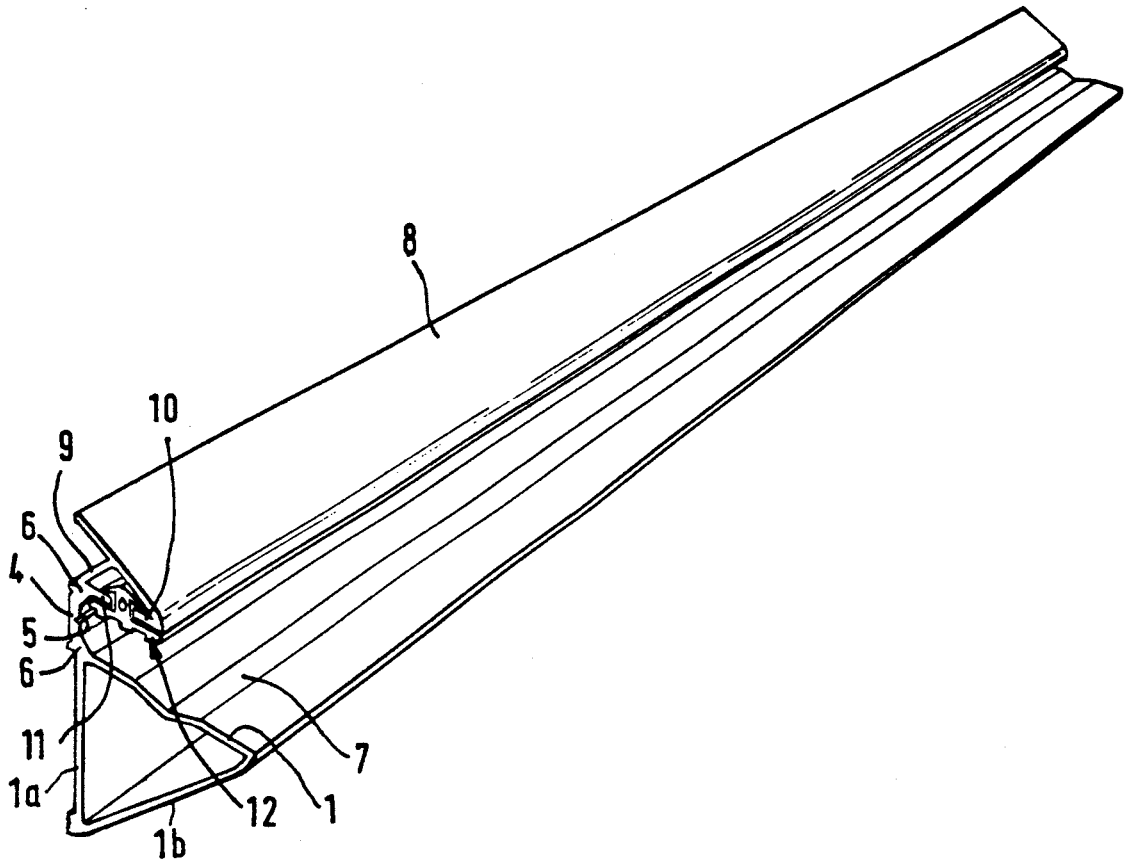

This application is a continuation-in-part of U.S. Ser. No. 865 850 filed on May 22nd. 1986, abandoned.

BACKGROUND OF THE INVENTION

The Present invention relates to a shelf support of the type which is elongate and is for extending along a substantial Part of the rear of a rectangular-section shelf and holding it as a cantilever, this type of shelf support having a rigid support member upon which the underside of the rear part of the shelf will rest, a rigid retaining member for retaining the top of the rear part of the shelf, and a rigid member which interconnects the support and retaining members, whereby the shelf support can be fixed to a vertical wall and thereby mount the shelf on the wall.

U.S. Pat. No. 4 508 301 discloses such a shelf support, and in practice such shelf supports have had considerable commercial success. U.S. Pat. No. 4 508 301 also discloses that an insert can be Placed under the retaining member in order to hold shelves of reduced thickness, but the insert used is a rigid insert It is understood that no materials are absolutely rigid, and indeed the shelf support of U.S. Pat. No. 4 508 301 and some embodiments of the shelf support of the Present invention do rely on some elastic distortion of the retaining member or interconnecting member; however, in a general sense, the support member, retaining member and interconnecting members are rigid.

The shelf support of U.S. Pat. No. 4 508 301 has given some problems when supporting glass shelves. The force necessary to insert the shelf may cause some chipping or breakage of the glass.

U.S. Pat. No. 2 477 771 discloses a shelf support which is not of the cantilever type and which does not extend along a substantial Part of the rear of the shelf, not being elongate. However, the problem of supporting and suitably clamping glass shelves is considered and is solved using a normal shelf bracket at each end of the glass shelf but with resilient fingers which engage the top of the rear Part of the shelf and a ramp on the top of the rear Part of the bracket which causes the glass shelf to rise as it is Pushed home and to Push the resilient finger upwards. This arrangement is not easy to fabricate and assemble and the use of resilient fingers would give Problems when applied to an elongate shelf support; the fingers would have to be in the form of an upper flange which would have to be of sufficiently low resilience to enable the glass shelf to be pushed home without difficulty.

Before making the present invention, the inventors were aware of an extruded shelf support of said type where however the front portion of the support member had an undercut groove in its upper side with a flexible insert held in the groove and forming an arcuate bulge at the very front of the upper side of the support surface. This shelf support is for normal shelves of say 15 mm thickness and is not for glass shelves. The insert does not reduce the force required for insertion.

The Invention

According to the invention, the retaining member carries an elastically-deformable member which will engage the top side of the rear Part of the shelf and elastically deforms when the shelf is in Position, the elastically-deformable member being a strip which runs along the bottom of the retaining member.

The use of the elastically-deformable strip enables a glass shelf to be retained without marked risk of damaging the shelf. Specifically, the shelf support prevents easy removal of the shelf—easy removal is highly undesirable as it can Permit accidental dislodgement. The elastically-deformable member is substantially spaced behind the front of the support member and this gives firm retention and little elastic movement of the shelf if its front edge is Pulled down. The shelf does not tend to ride out of the shelf-receiving slot.

The shelf support can be manufactured of just two components, and is simple in fabrication and assembly. Both components can be formed as extrusions; the support member, retaining member and interconnecting member can be formed as an integral unit as for instance an aluminium extrusion; the elastically- deformable member can be formed as an extrusion of an elastomer such as rubber or a suitable Plastics material.

Although some slight flexing of the retaining member can occur with respect to the support member, in substance all the distortion that occurs when inserting the shelf occurs in the elastically-deformable member.

However, the use of an elastically-deformable strip as such gives problems in that the strip tends to be pushed back and bunched up when the shelf is pushed home. In order to avoid this, the strip may, as seen in vertical cross-section, comprise a main part having at least one downwards Protuberance which is substantially narrower (front to rear) than the main Part. The downwards protuberance is more easily deformed than the main strip and does not apply enough force to the main strip to cause the main strip as a whole to be Pushed right back (although the main strip will move back to some extent in normal circumstances). In this way, a firm and secure mounting can be Provided for a glass shelf. In addition, when the shelf is under load and tends to tip forwards, the main Part offers greater resistance than the Protuberance and this limits the tipping movement.

There is an incidental advantage Such shelf supports are normally fixed to the vertical wall by using screws which are located at the rear of the slot which receives the rear part of the shelf. Shelves such as glass shelves are relatively thin, and thus the slot will be thin. By using the elastically-deformable strip, the screws can have heads whose diameter is just slightly less than the distance between the rigid retaining member and the rigid support member, and a full-width screw-driver can be used to screw the screw home; the screw-driver will distort the strip, but this distortion is mainly elastic and does not matter in practice.

It is an advantage that the width (front to rear) or depth (top to bottom) of the Protuberance can be increased or decreased in order to alter the compression on the shelf. It is also considered that the use of the relatively thin protuberances gives better grip where, as is preferred, the protuberance or one of the protuberances is beneath the front part of the retaining member, and if the shelf is first of all Put in position with its front edge raised, the top rear edge of the shelf engages towards the rear of the protuberance, or actually behind the protuberance; this helps avoid pushing the Protuberance and hence the whole strip backwards with the leading edge of the shelf. When the shelf is in position, this front Protuberance grips the shelf and also stops the front of the shelf being lifted up.

If, as is preferred, there is a protuberance which is intermediate the front and the rear of the retaining member, this Protuberance is able to resist being pushed backwards as the shelf is Pushed home, Particularly if the strip is retained at a Position between its front and rear. This middle Protuberance acts mainly to grip the shelf when the shelf is in Position. Also, while the shelf is being Pushed home, the middle protuberance keeps the rear edge of the shelf down and stops the rear edge jamming against the rear Protuberance, if there is a rear Protuberance. The middle Protuberance is preferably narrower than the front Protuberance in order to enable the shelf to slide more easily under the middle protuberance.

The rear protuberance, if present, acts to grip the shelf when it is in position, and also stops the shelf front tipping down. The rear Protuberance is narrower than the middle or front Protuberances (if Present) so that the shelf slides more easily under the rear protuberance.

In a useful construction, the retaining member comprises (as seen in vertical section) a first, top, forwardly and downwardly inclined Part whose top, rear end is arranged to abut o nearly abut the vertical wall to give bracing, a second, forwardly and upwardly inclined part connected to the interconnecting member and joining the first part intermediate its length a horizontal lip extending rearwards from the front, lower end of the first part, and a horizontal lip extending forwards from the rear, lower end of the second part, the lips defining therebetween a slot which receives part of the elastically-deformable member in order to retain the elastically-deformable member in Position. The lower portion of the first part, the second part and the two lips form a generally triangular shape, and provide a good, sufficiently rigid construction.

The dip shown in the support surface of the shelf support of U.S. Pat. No. 4 508 301 can be provided, but is not essential. Although the shelf support was designed for use with glass shelves, the shelf may for instance be formed of Plywood or perspex.

The Drawings

Figure 2:
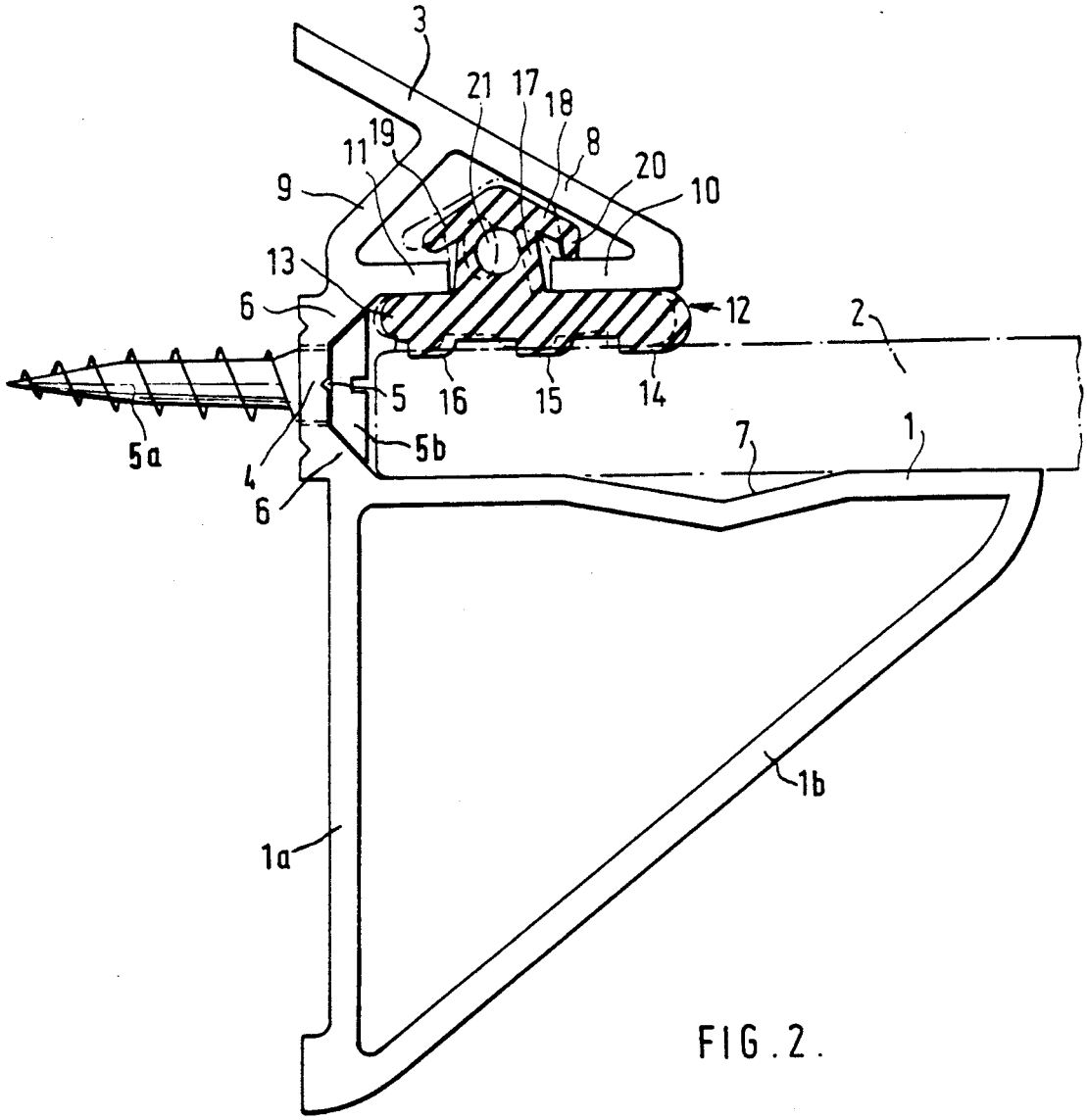
Figure 3:
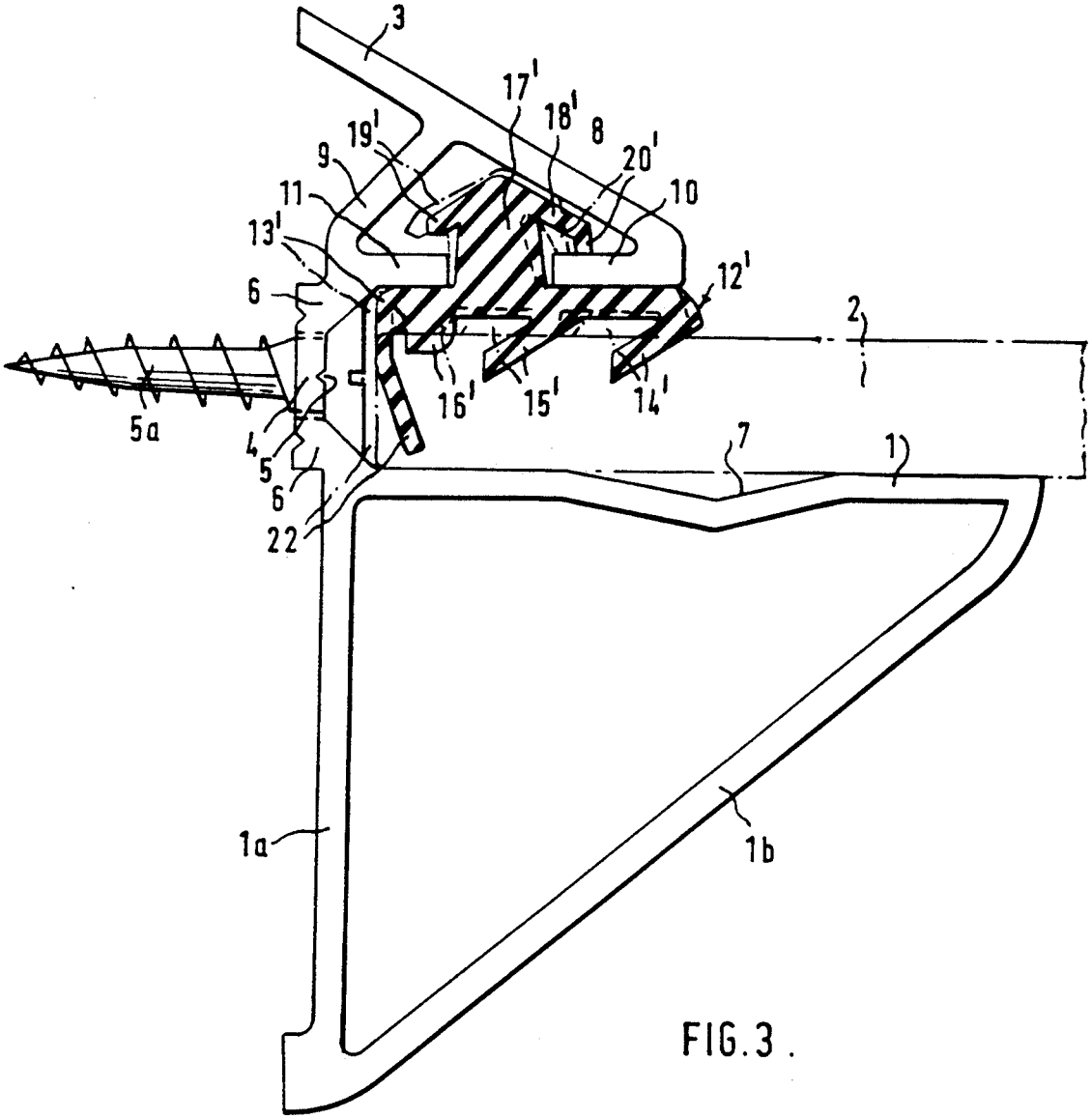

The invention will be further described, by way of example, with reference to the accompanying drawings, in which:

FIG. 1 a perspective view of a Preferred shelf support accordance with the invention;

FIG. 2 an enlarged, vertical section through the upper P of the shelf support, showing in dashed outline a glass shelf in position and the resultant configurating of the elastically-deformable member; and FIG. 3 is as FIG. 2, but shows a different elastically-deformable member.

FIGS. 1 and 2

The shelf support shown is intended to be of the same length as the shelf. i.e. will extend along the whole of the rear of the shelf. As can be seen in FIG. 1, the shelf support generally comprises a rigid support member 1 upon which the underside of the rear Part of the shelf 2 (see FIG. 2) rests, a rigid retaining member 3 which retains the top of the rear Part of the shelf 2, and a rigid Plate-like member 4 which interconnects the support and retaining members 1,3 and serves to fix the shelf support to a vertical wall (not shown). The support and retaining members 1.3 define therebetween a shelf-receiving slot which is Parallel-sided, at least in the sense that the underside of the shelf 2 is parallel to the underside of the retaining member 3. The interconnecting member 4 is Provided with a narrow groove 5 for locating screw-holes and has inclined surfaces or shoulders 6 which also Provide abutment surfaces for screws 5*a* with countersink heads 5*b;* the lower shoulder 6 also limits the rearwards movement of the shelf 2 so that the shelf 2 does not foul the heads of the screws 5*b* and so that the top rear corner of the shelf 2 does not bear against a rigid part. The support member 1 Projects about double as far from the rear of the shelf support (i.e. from the wall) as the retaining member 3, i.e. the forwards extent of the retaining member 3 is roughly one half of that of the support member 1, but the support member 1 will only engage a small fraction of the width of the shelf 2, e.g. about one fifth of the width of the shelf 2.

The support member 1 is of braced construction, generally as described in U.S. Pat. No. 4 508 301 or in GB 2 053 666B. In effect, the interconnecting member 4 extends down below the shelf-engaging surface of the support member 1 to Provide a rear Part 1*a* roughly of the same extent as the forwards extent of the support member 1, and in this embodiment, there is an inclined brace 1*b*, though other forms of bracing can be used. The support member 1 has a dip 7 in its support surface. to facilitate the entry of a shelf, generally as described in U.S. Pat. No. 4 508 301 . Whether or not the dip 7 is present, it is generally desirable that the shelf 2 should be inserted with its front edge raised, i.e. with the shelf 2 inclined downwardly and rearwardly.

The retaining member 3 has (as seen in vertical section) a first, top, forwardly and downwardly inclined part 8 whose top, rear end is arranged to abut the vertical wall to give bracing, a second, forwardly and upwardly inclined Part 9 connected to the interconnecting member 4 and joining the first Part 8 intermediate its length, a horizontal lip or return 10 extending rearwards from the front, lower end of the first Part 8, and a horizontal lip 11 extending forwards from the front, lower end of the second part 9. The lips 10,11 define therebetween a slot which receives Part of an elastically-deformable member or strip 12 in order to retain the strip 12 in position.

The strip 12 is shown to scale in FIG. 2. The strip 12 can be made of any suitable material, though a soft elastomer should be chosen which however gives good extrusion characteristics. One example is an ICI flexible PVC sold under the name of "Welvic". grade G6/344 which has a relative density (specific gravity) of 1.46, a British Standard softness and a Shore A hardness of 65 and a Percentage elongation of 340. An alternative is a "Welvic" grade G6/942 which has a specific gravity of 1.37, though the same hardness. In general, a Shore A hardness of 50–80 is Preferred. The material is substantially homogeneous.

The strip 12 has a Parallel-sided main Part 13, and, on the underside of the main Part 13, front, middle and rear Protuberances 14,15.16 and. on its top, an upwards projection 17.

The Protuberances 14,15,16 are substantially narrower (front to rear) than the main Part 13 and are also graduated so that the front Protuberance 14 is wider than the middle protuberance 15 which is wider than the rear protuberance 16. The main Part 13 has a flat underside between adjacent Protuberances 14,15,16 and the distance apart of the Protuberances 14,15,16 is roughly equal to their width. The width of each Protuberance 14.15,16 is at least twice its depth, Preferably from about 2.5 to about 2 or 4.5 or 5 times its depth. Just by way of example, if the main Part 12 has a width of 10.5 mm, the widths of the Protuberances 14 15,16 can be 2.5 mm, 2 mm and 1.5 mm respectively. In addition, the middle protuberance 15 is closer to the front Protuberance 14 than to the rear protuberance 16: the spacings between the protuberances can be 1.5 mm between the protuberances 14,15 and 2 mm between the protuberances 15,16. Each protuberance 14,15,16 has a depth which is between one half and one quarter of the depth of the main part 13. preferably about two fifths of the depth of the main part 13. For example, the protuberances can have a depth of 0.6 mm and the main part a depth of 1.5 mm. The fact that the protuberances 14,15,16 are relatively low and wide enables the shelf 2 to be inserted without great difficulty, but also gives good retention to the shelf 2. Each protuberance 14,15,16 has its front surface radiussed into its bottom surface and a vertical rear surface—this eases insertion of the shelf 2 and makes removal harder; the protuberances 14,15,16 tend to diq in without bending over when the shelf 2 is removed.

The front protuberance 14 is beneath the front part of the retaining member 3, but Projects slightly forwards. The middle Protuberance is ahead of the centre line of the upwards Projection 17, and the rear Protuberance 16 is spaced slightly from the very rear of the main part 13. The Positioning of the upwards Projection 17 reduces the twisting effect on the main part 13 as the shelf 2 is inserted. The rear of the Projection 17 meets the main Part 13 immediately above the front of the rear Protuberance 16.

The upwards Projection 17 makes a relatively loose fit in the slot between the lips 10.11; it has a forwardly-Projecting flange 18 and a rearwardly-projecting flange 19, the flanges lying above the lips 10,11. The front flange 18 has a downturned lip 20 which engages the top of the lip 10 The first and second Parts 8.9 form a closed space over the slot between the lips 10,11, having a cross-sectional area greater than that of the Projection 17 so that the projection 17 does not fill the closed space and can distort upwards as shown in the dot-dash lines. This gives much greater tolerances for shelves—if the shelf 2 is thicker, more of the main Part 13 can be Pushed up not the slot between the lips 10.11. The projection 17 has a void space 21 to aid its distortion, for the same purpose.

FIG. 2 shows in dashed outline the configuration adopted by the strip 12 when the shelf 2 is inserted.

The shelf 2 is held by friction, and Projects as a cantilever. It will be noted that the shelf 2 has a radiussed rear edge, which assists insertion, and is normally Provided on glass shelves. Purely by way of example, the shelf may have a nominal thickness of 6 mm (or 6.35 mm, a quarter inch) ±0.25 mm, the gap between the support member 1 and the retaining member 3 be 8 mm (or 8.35 mm) and the height of the strip main part 13 and Protuberances 14,15,16 be 2.1 mm, giving an interference of 0.1 mm or roughly 5% compression of the strip 13. It is useful to aim for a compression of between 2% and 10%.

For marketing, end caps as shown in US 4 508 301 may be provided, but are not shown.

FIG. 3

Apart from the strip 12' the shelf support of FIG. 3 is the same as that of FIG. 2. For the strip 12', the same references are used as for the strip 12 of FIG. 2, but Primed. Parts are only described where there are significant differences.

As shown in dashed-dot line, the Protuberances 14',15' although relatively long and thin, bend back upon insertion of the shelf 2 and assume a configuration very similar to that of the Protuberances 14,15 of FIG. 2, when the shelf 2 is in Position.

The rear of the strip 12' has a downwardly-projecting flap 22 which is engaged by the rear of the shelf 2 as the shelf is pushed home and Protects the rear of the shelf 2 by providing a cushion between it and the shoulders 6 and screw head **5*b***.

We claim:

1. An elongate shelf support for extending along a substantial part of the rear of a rectangular-section shelf and holding the shelf as a cantilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member;

an elastically-deformable member running along the underside of the retaining member, for engaging the top of the rear part of the shelf and elastically deforming when the shelf is in position, the elastically deformable member comprising, as seen in vertical section, a main part having at least one downwards protuberance which is substantially narrower (front to rear) than the main part; and a rigid member which interconnects the support and retaining members, whereby the shelf support can be fixed to a vertical wall and thereby mount the shelf on the wall, and the support member projecting substantially further from the wall than the retaining member so that the elastically-deformable member is disposed substantially to the rear of said front part of the support member;

said main part comprising at least a front said protuberance and a rear said protuberance, said front protuberance being effectively wider, front to rear, than said rear protuberance.

2. An elongate shelf support for fixing to a vertical wall and for extending along a substantial part of the rear of a rectangular-section glass shelf of thickness roughly one quarter inch, and holding the shelf as a cantilever, the shelf support comprising:

a rigid support member upon which the underside of the rear part of the shelf will rest;

a rigid retaining member for retaining the top of the rear part of the shelf by friction, the forwards extent of the rigid retaining member being roughly one half of that of the support member, the retaining member comprising, as seen in vertical section, a first, top, forwardly and downwardly inclined part whose top, rear end is arranged to abut or nearly abut a vertical wall to give bracing, a second, forwardly and upwardly inclined part joining the first part intermediate its length, a first, horizontal lip extending rearwards from the front, lower end of said first part, and a second, horizontal lip extending forwards from the rear, lower end of said second part, the first and second lips defining therebetween a slot, and the first and second parts defining a closed space above said slot;

an elastically-deformable member having a Shore A hardness of about 65 extending along the bottom of the retaining member, for engaging the top of the rear part of the shelf and elastically deforming when the shelf is in position, the underside of the retaining member and the underside of the elastically-deformable member being substantially parallel to the plane defined by the upper surface of the support member and in which the underside of the shelf will lie, and the underside of the elastically-deformable member and the top of the support member defining a shelf-receiving slot of a height slightly less than one quarter inch, the elastically-deformable member comprising an upwards projection engaging in and retained by said slot to retain the elastically-deformable member in position, the upwards projection having a cross-sectional area which is substantially less than that of said closed space whereby the upwards projection does not fill said closed space whereby the upwards projection does not fill said closed space, and there being a void space in the upwards projection, to thereby assist the deformation of the upwards projection when a shelf is inserted into the shelf-receiving slot of the shelf support, the upwards projection having a forwardly-projecting flange with a down-turned lip which engages the top of said first, horizontal lip, the elastically-deformable member also comprising, as seen in vertical section, a main part which lies beneath the retaining member and three downwards protuberances on the main part, each of which is substantially narrower, front to rear, than the main part and said main part having a flat underside between adjacent downward protuberances with a distance apart of the downwards protuberances being roughly equal to the width of the downwards protuberances, each downwards protuberance having, as seen in vertical section, an effective width which is from about 2.5 to about 4.2 times its depth, the effective depth of each downwards protuberance being less than half but greater than a quarter of the depth of said main part, the front surface of each downwards protuberance effectively being radiussed into the bottom surface of the respective protuberance and the rear surface of each downwards protuberance being substantially vertical, the front downwards protuberance being beneath the front part of the retaining member but said main part projecting slightly forwards of the retaining member and the front surface of said main part being radiussed into the top of said main part, the upwards projection being between the base of one downwards protuberance and the base of another downwards protuberance; and a rigid member which interconnects the support and retaining members and is connected to said second part of the retaining member, the rigid interconnecting member extending down substantially below the shelf-engaging surface of the support member, to provide bracing of the support member against said wall, the interconnecting member defining a front surface at the back of the shelf-receiving slot, in which holes can be drilled for fixing the interconnecting member and hence the shelf support to said wall, and inclined surfaces being provided where the upper surface of the support and the lower surface of the retaining member meet the front surface of the interconnecting member, whereby a screw fixing can be made through the interconnecting member and a countersink screw used with the underside of the screw head bearing against said inclined surfaces;

whereby the shelf can be inserted in the shelf-receiving slot and fixed in a cantilever fashion with the rear of the shelf retained by the elastically-deformable member and the front of the support member engaging the underside of the shelf at a position substantially in front of the elastically-deformable member.

3. An elongate shelf support for extending along a substantial part of the rear of a rectangular-section shelf and holding the shelf as a contilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member, the retaining member comprising, as seen in vertical section, a first top, forwardly and downwardly inclined part, a second, forwardly and upwardly inclined part connected to the interconnecting member and joining the first part at a position spaced from its front, and a horizontal lip extending rearwards from the front, lower end of said first part, said lip defining the front edge of said slot or groove;

an elastically-deformable member running along the underside of the retaining member, for engaging the top of the rear part of the shelf and elastically deforming when the shelf is in position, the elastically deformable member comprising, as seen in vertical section, a main part having at least one downwards protuberance which is substantially narrower (front to rear) than the main part; and a rigid member which interconnects the support and retaining members, whereby the shelf support can be fixed to a vertical wall and thereby mount the shelf on the wall, and whereby the support member projecting substantially further from the wall than the retaining member so that the elastically-deformable member is disposed substantially to the rear of said front part of the support member.

4. The shelf support of claim 3, wherein the retaining member also comprises a second horizontal lip extending forwards from the rear, lower end of said second part, the first mentioned lip and the second lip defining therebetween said slot or groove.

5. An elongate shelf support for extending along a substantial part of the rear of a rectangular-section shelf and holding the shelf as a cantilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member;

an elastically-deformable member running along the underside of the retaining member, for engaging the top of the rear part of the shelf and elastically deforming when the shelf is in position, the elastically deformable member comprising, as seen in vertical section, a main part having at least one downwards protuberance which is substantially narrower (front to rear) than the main part; and a rigid member which interconnects the support and retaining members, whereby the shelf support can be fixed to a vertical wall and thereby mount the shelf on the wall, and the support member projecting substantially further from the wall than the retaining member so that the elastically-deformable member is disposed substantially to the rear of said front part of the support member, said downwards protuberance having, as seen in vertical section at right angles to the position of said wall, an effective width which is at least twice its depth.

6. The shelf support of claim 5 wherein said protuberance is beneath the front Part of the retaining member but its front part projects slightly forwards of the retaining member.

7. The shelf support of claim 5, wherein said protuberance is beneath the rear Part of the retaining member but spaced slightly from the rear edge of said main part.

8. The shelf support of claim 5, wherein there are three said protuberances.

9. The shelf support of claim 5, wherein the front surface of said protuberance is effectively radiussed into the bottom surface of said protuberance and the rear surface of said protuberance is effectively substantially vertical.

10. The shelf support of claim 5, wherein the effective depth of said protuberances is less than half but greater than a quarter of said main part.

11. The shelf support of claim 5, wherein the front of a said protuberance is roughly aligned with the front of said main part, and the front surface of said main part is radiussed into the top of said main part.

12. The shelf support of claim 5, wherein the underside of the retaining member is substantially parallel to the plane defined by the upper surface of the support member and in which the underside of the shelf will lie, and wherein said main part of the elastically-deformable member has parallel top and bottom surfaces.

13. The shelf support of claim 5, wherein the elastically-deformable member is formed of a single material having a Shore A hardness of about 65.

14. The shelf support of claim 5, wherein the retaining member defines a downwards-facing slot or groove, and the elastically-deformable member has, above said main part, an upwards Projection which engages in and is retained in the slot or groove.

15. The shelf support of claim 5, wherein the support member and the retaining member define therebetween a shelf-receiving slot, and wherein fixing means are provided on the rigid interconnecting member at the rear of the shelf-receiving slot, for fixing the shelf support to the vertical wall.

16. The shelf support of claim 5, wherein inclined surfaces are provided where the upper surface of the support member and the lower surface of the retaining member meet a front vertical surface of the interconnecting member, whereby a screw fixing can be made through the interconnecting member and a countersink screw used with the underside of the screw head bearing against said inclined surfaces.

17. The shelf support of claim 5, wherein the rigid interconnecting member extends down substantially below the shelf-engaging surface of the support member, to provide bracing of the support member against the wall.

18. The shelf support of claim 5, wherein the forwards extent of the rigid retaining member is roughly one half of that of the support member.

19. The shelf support of claim 5, for supporting a rectangular-section glass shelf of thickness roughly one quarter inch, wherein the base of the elastically-deformable member and the top of the support member defining shelf-receiving slot of a height slightly less than one quarter inch.

20. An elongate shelf support for extending along a substantial part of the rear of a rectangular-section shelf and holding the shelf as a cantilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member;

an elastically-deformable member running along the underside of the retaining member, for engaging the top of the rear part of the shelf and elastically deforming when the shelf is in position, the elastically deformable member comprising, as seen in vertical section, a main part having at least one downwards protuberance which is substantially narrower (front to rear) than the main part; and a rigid member which interconnects the support and retaining members, whereby the shelf support can be fixed to a vertical wall and thereby mount the shelf on the wall, and the support member projecting substantially further from the wall than the retaining member so that the elastically-deformable member is disposed substantially to the rear of said front par of the support member, said downwards protuberance having, as seen in vertical section at right angles to the position of said wall, an effective width which is from about 2.5 to about 4.2 times its depth.

21. An elongate shelf support for extending along a substantial part of the rear of a rectangular-section shelf and holding the shelf as a cantilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member;

an elastically-deformable member running along the underside of the retaining member, for engaging the top of the rear part of the shelf and elastically deforming when the shelf is in position, the elastically deformable member comprising, as seen in vertical section, a main part having at least two downwards protuberances which are each substantially narrower (front to rear) than the main part; and a rigid member which interconnects the support and retaining members, whereby the shelf support can be fixed to a vertical wall and thereby mount the shelf on the wall, and the support member projecting substantially further from the wall than the retaining member so that the elastically-deformable member is disposed substantially to the rear of said front part of the support member, said main part having a flat underside between said downwards protuberances and the effective distance apart of said downwards protuberances being roughly equal to the effective width of said downwards protuberances.

22. An elongate shelf support for extending along a substantial part of the rear of a rectangular-section shelf and holding the shelf as a cantilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member;

an elastically-deformable member running along the underside of the retaining member, for engaging the top of the rear part of the shelf and elastically deforming when the shelf is in position, the elastically deformable member comprising, as seen in vertical section, a main part having at least one downwards protuberance which is substantially narrower (front to rear) than the main part; and a rigid member which interconnects the support and retaining members, whereby the shelf support can be fixed to a vertical wall and thereby mount the shelf on the wall, and the support member projecting substantially further from the wall than the retaining member so that the elastically-deformable member is disposed substantially to the rear of said front part of the support member, said retaining member defining a downwards-facing slot or groove, and the elastically-deformable member having, above said main part, an upwards projection which engages in and is retained in the slot or groove, said retaining member comprising a part extending over said slot or groove to define a closed space above said slot or groove and containing the upper part of said upwards projection, said upwards projection having a cross-sectional area which is substantially less than that of said closed space, whereby said upwards projection does not fill said closed space.

23. The shelf support of claim 2, wherein the elastically-deformable member has at least two adjacent downwards protuberances on said main part, and wherein the centre line of said upwards projection of the elastically-deformable member is between the base of one said protuberance and the base of the other said adjacent protuberance.

24. An elongate shelf support for extending along a substantial part of the rear of a rectangular-section shelf and holding the shelf as a cantilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member;

an elastically-deformable member running along the underside of the retaining member, for engaging the top of the rear part of the shelf and elastically deforming when the shelf is in position, the elastically deformable member comprising, as seen in vertical section, a main part having at least one downwards protuberance which is substantially narrower (front to rear) than the main part; and a rigid member which interconnects the support and retaining members, whereby the shelf support can be fixed to a vertical wall and thereby mount the shelf on the wall, and the support member projecting substantially further from the wall than the retaining member so that the elastically-deformable member is disposed substantially to the rear of said front part of the support member, said retaining member defining downward-facing slot or groove, the elastically-deformable member having, above said main part, an upwards projection which engages in and is retained in the slot or groove, and a void space being created in said upwards projection, to thereby assist the deformation of said upwards projection when a shelf is inserted in the shelf support.

25. An elongate shelf support for extending along a substantial part of the rear of a rectangular-section shelf and holding the shelf as a cantilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member;

an elastically-deformable member running along the underside of the retaining member, for engaging the top of the rear part of the shelf and elastically deforming when the shelf is in position, the elastically deformable member comprising, as seen in vertical section, a main part having at leas tone downwards protuberance which is substantially narrower (front to rear) than the main part; and a rigid member which interconnects the support and retaining members, whereby the shelf support can be fixed to a vertical wall and thereby mount the shelf on the wall, and the support member projecting substantially further from the wall than the retaining member so that the elastically-deformable member is disposed substantially to the rear of said front part of the support member, the retaining member defining a downwards-facing slot or groove, the elastically-deformable member having, above said main part, an upwards projection which engages in and is retained in the slot or groove, said projection having an forwardly-projecting flange, said slot or groove being defined along its front by a rearwardly-projecting lip, and the flange having a downturned lip which engages the top of the rearwardly-projecting lip.

26. An elongate shelf support for extending along a substantial part of the rear of a rectangular-section shelf and holding the shelf as a cantilever, the shelf support comprising:

a rigid support member upon which the underside of the rear part of the shelf will rest, said support member having a front part;

a rigid retaining member for retaining the top of the rear part of the shelf, which retaining member has a front to rear extent which is substantially less than the front to rear extent of the support member;

an elastically-deformable member running along the underside of the retaining member, for engaging the top of the rear part of the shelf and elastically deformable member comprising, as seen in vertical section, a main part having at least one downwards protuberance which is substantially narrower (front to rear) than the main part; and a rigid member which interconnects the support and retaining members, whereby the shelf support can be fixed to a vertical wall and thereby mount the shelf on the wall, and the support member projecting substantially further from the wall than the retaining member so that the elastically-deformable member is disposed substantially to the rear of said front part of the support member, the support member and the retaining member defining therebetween a shelf-receiving slot for receiving the shelf, the shelf-receiving slot having a rear, the shelf having a bottom rear part and a top rear part, and a member being provided at the rear of the shelf-receiving slot for engagement by the bottom rear part of the shelf, thereby preventing the top rear part of the shelf from engaging a rigid part of the shelf support.

* * * * *